US006869009B2

(12) United States Patent
Sutherland et al.

(10) Patent No.: US 6,869,009 B2
(45) Date of Patent: Mar. 22, 2005

(54) CARTON WITH TOP DISPENSING FEATURE

(75) Inventors: Robert L. Sutherland, Kennesaw, GA (US); Raymond R. Spivey, Sr., Mableton, GA (US); Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/626,234

(22) Filed: Jul. 24, 2003

(65) Prior Publication Data

US 2004/0155099 A1 Aug. 12, 2004

Related U.S. Application Data

(63) Continuation-in-part of application No. 10/360,232, filed on Feb. 6, 2003, now Pat. No. 6,604,677.

(51) Int. Cl.[7] ..... B65D 5/54

(52) U.S. Cl. ..... 229/121; 229/122; 229/160.2; 229/242

(58) Field of Search ..... 229/121, 122, 229/122.1, 160.2, 242, 925; 206/427, 831; 221/305

(56) References Cited

U.S. PATENT DOCUMENTS

| | | | | | |
|---|---|---|---|---|---|
| 3,829,006 | A | * | 8/1974 | Spiegel | 229/242 |
| 4,252,236 | A | * | 2/1981 | Roccaforte | 229/122 |
| 4,318,474 | A | * | 3/1982 | Hasegawa | 229/242 |
| 4,331,289 | A | * | 5/1982 | Killy | 206/427 |
| 4,396,143 | A | * | 8/1983 | Killy | 229/122.1 |
| 4,398,636 | A | * | 8/1983 | Baxter | 229/242 |
| 4,417,661 | A | * | 11/1983 | Roccaforte | 229/925 |
| 4,426,035 | A | * | 1/1984 | Dieckow | 206/526 |
| 4,498,581 | A | * | 2/1985 | Dutcher | 206/427 |
| 4,620,664 | A | * | 11/1986 | Kaufman et al. | 206/831 |
| 6,604,677 | B1 | * | 8/2003 | Sutherland et al. | 229/242 |

* cited by examiner

*Primary Examiner*—Gary E. Elkins
(74) *Attorney, Agent, or Firm*—Womble Carlyle Sandridge & Rice, PLLC

(57) ABSTRACT

A carton with a new type of dispenser that is placed midway between the ends of the carton adjacent a fold line between the top panel and adjoining side panel. The dispenser is designed so that it is slightly larger than the diameter of the bottom ends of from two to three containers. The dispenser may have a push tab or starting flap to aid in commencing tearing the dispenser flap open. A coupon may be located on the inside or outside of the dispenser flap.

17 Claims, 7 Drawing Sheets

CARTON WITH TOP DISPENSING FEATURE

CROSS-REFERENCE TO RELATED APPLICATION

This application is a continuation-in-part of U.S. utility application entitled, "Carton With Top Dispensing Feature," having Ser. No. 10/360,232, filed Feb. 6, 2003, now U.S. Pat. No. 6,604,677, which is entirely incorporated herein by reference.

BACKGROUND OF THE INVENTION

1. Field of the Invention

The present invention relates generally to an enclosed paperboard carton capable of enclosing cylindrical containers, such as bottles, with a top of a smaller diameter than the bottom, which carton has a unique opening and dispensing feature in the top panel which allows the containers to be removed or dispensed one at a time by grasping the top of the container and pulling it through the opening. The opening is located approximately equidistance between the ends of the carton adjacent to a fold line between the top panel and an adjacent side panel. The opening is closed by a dispensing flap that is tightly attached to the carton by a resistant tear line. A push tab may be provided to commence tearing the dispensing flap open. Containers are dispensed from this carton while the carton is resting on a side panel adjacent to the dispenser in the top panel. The dispenser may have an opening large enough to expose from two to three bottles to facilitate easy removal of the bottles from the carton.

2. Background

Fully enclosed cartons capable of enclosing containers have been used in the past that have a feature for dispensing the containers one at a time. Dispensers have been provided at various locations within these cartons depending on the design. Many of these dispensers suffer from the disadvantage that once open, they allow all of the containers to roll out. In addition, it is difficult to carry one of these cartons without the containers falling out once the dispenser has been opened. Most of these dispensers have been designed for dispensing cans or bottles which have cylindrical tops and bottoms of substantially the same size and configuration. These dispensers are often not suitable for dispensing bottles that have a neck of smaller diameter than the body of the bottle.

Many of these dispensers destroy the overall carton integrity once they have been opened.

Many of these dispensers do not have any means for the easy opening of the dispenser for dispensing the containers inside the carton one at a time. Furthermore, many dispensers are not set up so that the containers inside the carton roll into the position for dispensing once a container has been removed from the dispenser.

SUMMARY OF THE INVENTION

This invention relates to an enclosed carton for carrying bottles that has a unique dispenser or opening in the top panel of the carton midway between two ends of the carton. The blank for this carton is generally rectangular and has a bottom panel, top panel, two side panels and two ends. The carton is foldably constructed from a blank having panels and flaps. The dispenser or opening is formed in the top panel midway between the two ends of the carton adjacent a fold line between the top panel and side panel. A tear line is provided which defines the dispenser flap in the top panel.

After the dispenser flap has been removed, the dispenser opening may be designed to expose from two to three bottles for removal. The unique dispenser of this invention is designed to be used with bottles that have a neck and bottle cap of smaller diameters than the main body of the bottle.

One embodiment of this invention has a dispenser opening which exposes two bottles. The dispenser opening is located approximately midway between the ends of the carton adjacent to a fold line between the top panel and side panel. Part of a dispenser flap may extend into the adjacent side panel. A push tab may be provided between two V fold lines adjacent to the dispenser flap in the side panel so a person can push the push tab in and grab the dispenser flap for removal. If desired, this carton may be provided with twin dispensers in the top panel with each located along a fold line adjacent to a side panel.

Another embodiment of this invention involves a dispenser that when open exposes three bottles for removal. It may also have V fold lines in the adjacent side panel with tabs that can be pushed in so a person can grasp the dispenser flap for removal. A starting tab may also be provided in the top panel that may be pushed in so that the dispensing flap can be grabbed for easy removal.

While both of these embodiment have the dispenser located in the top panel the carton is placed for dispensing bottles so that it rests on the side panel immediately adjacent to the dispenser for easy removal of the bottles which lie on their sides on this side panel and automatically drop down towards the dispenser for easy removal.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
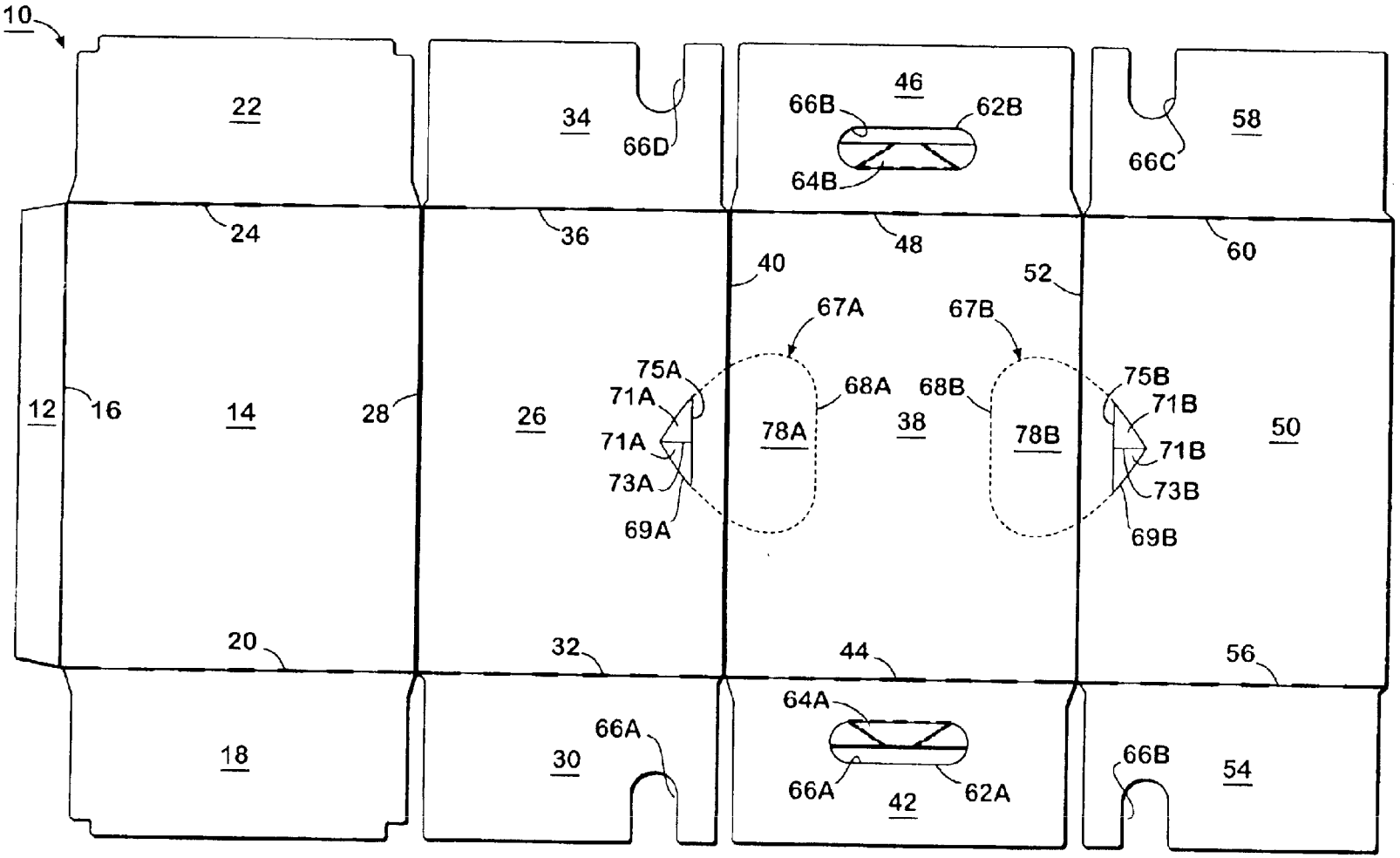
FIG. 1 is a plan view of a blank from which a carton according to one embodiment of this invention is formed.

The carton of the present invention is intended primarily for use with bottles which have a top with a smaller diameter than the bottom. It is especially designed to carry PET bottles. FIG. 1 is a plan view of a blank for forming one embodiment of this invention which has two dispensers in the top panel approximately of equidistance between the ends, with each dispenser being adjacent to a fold line between the top panel and a side panel. The carton formed from this blank is designed to hold 24 bottles. The blank 10 of FIG. 1 is formed from a foldably sheet material, such as paperboard. The blank 10 has a glue flap 12 which is attached to the bottom panel 14 by fold line 16. Bottom end flaps 18 and 22 are attached to bottom panel 14 by fold lines 20 and 24 respectively. Bottom panel 14 is attached to side panel 26 by fold line 28. Side panel 26 is attached to side end flaps 30 and 34 by fold lines 32 and 36 respectively. Side panel 26 is attached to top panel 38 by fold line 40. Top panel 38 is attached to top end flaps 42 and 46 by fold lines 44 and 48 respectively. Side panel 50 is attached to top panel 38 by fold line 52. Side panel 50 is attached to side end flaps 54 and 58 by fold lines 56 and 60 respectively.

This carton may be provided with handles 62A and 62B formed in top end flaps 42 and 46 respectively. The handles 62A and 62B may have handle flaps 64A and 64B. As this handle has a two ply structure, two handle cutouts 66A–B are provided so that a person's hand can be extended through handle 62A and handle cut outs 66A–B to lift one end of the carton. On the other end the hand is extended through handle 62B and handle cut outs 66C–D. On both ends two plys of paperboard are supporting the handle.

Twin dispensers 67A and 67B are formed largely in top panel 38 along fold lines 40 and 52 respectively. These dispensers 67A and 67B are formed at the midpoint between fold lines 44 and 48. These dispensers 67A and 67B are formed by resistant tear lines 68A and 68B respectively. These tear lines 68A and 68B run parallel to fold lines 40 and 52 for distance approximately equal to the diameter of two bottles to be contained in the carton formed from the blank. Tear lines 68A and 68B extend inwardly into top panel 38 a distance that is approximately equal to the diameter of a bottle to be contained in the carton formed from the blank of FIG. 1. Tear lines 68A and 68B are parallel to fold line 40 and fold line 52 respectively for distance equal to approximately the diameter of two bottles. These tear lines 68A and 68B then turn at each end and converge towards each other and extend through fold lines 40 and 52 into side panels 26 and 50 respectively until they meet V fold lines 69A and 69B at the top of each V. V fold lines 69A and 69B are foldably attached to push tabs 71A and 71B which are located inside the V and are separated by cut lines 73A and 73B extending from the bottom of V fold lines 69A and 69B respectively. A cut line 75A and 75B separates the push tabs 71A and 71B from the dispenser flap 78A and 78B respectively.

It will be understood by those skilled in the art that the carton of the present invention is generally symmetrical about a horizontal line of bisection, as viewed when FIG. 1 is rotated lengthwise. This symmetry aids in the efficient production of the present carton.

In forming this blank 10 into a carton, the carton is formed into a sleeve with glue flap 12 being glued to side panel 50. Bottles B having a top portion of a smaller diameter than the bottom portion can be loaded into the carton with the bottle cap C and bottle neck N being adjacent to the top panel 38. The various end flaps 18, 22, 30, 34, 42, 46, 54, and 58 can be glued together to finish the formation of the loaded carton.

It should be realized that this carton could be held together by conventional mechanical locks formed in the blank rather than glue.

Figure 2:
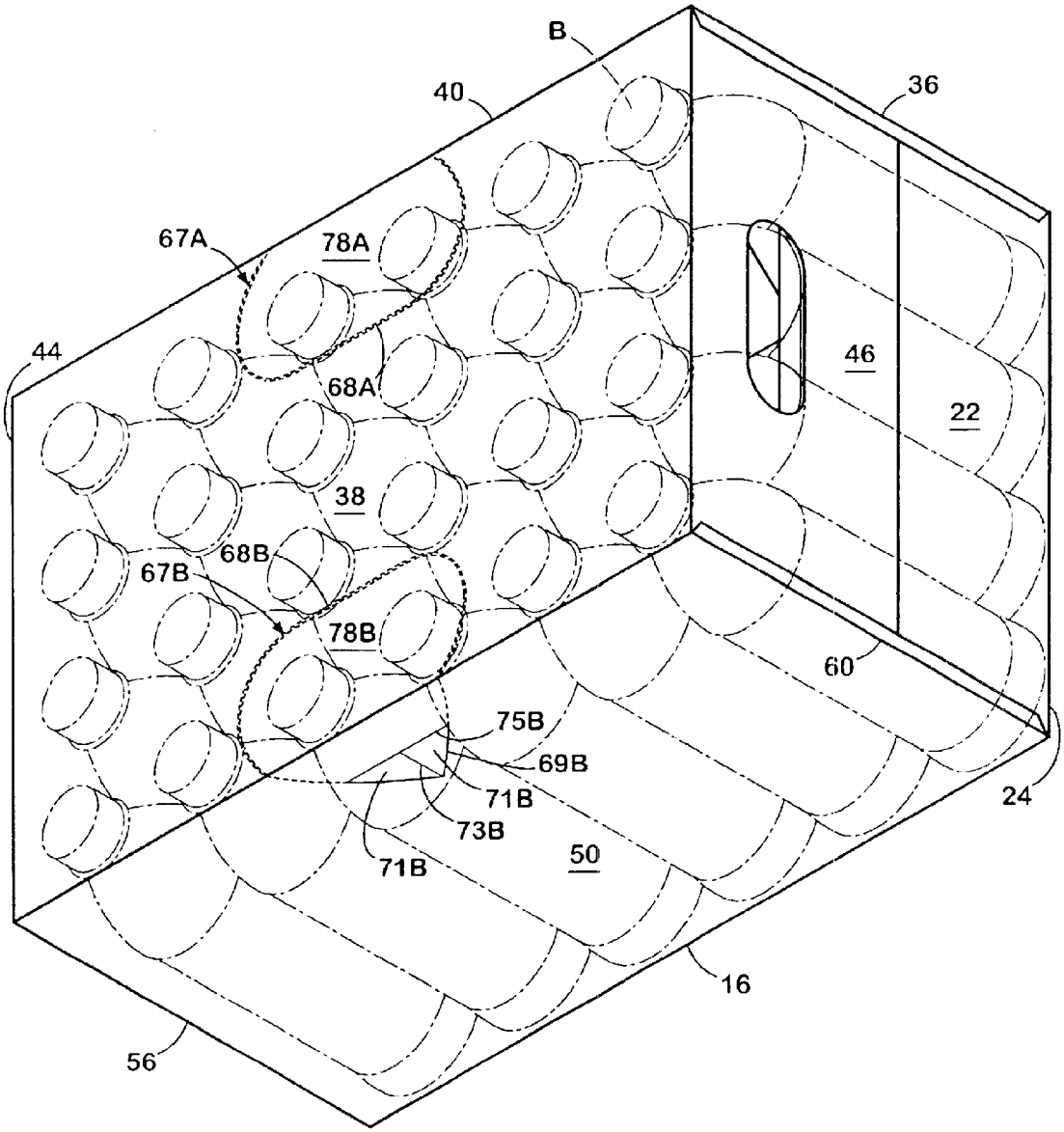
FIG. 2 is a perspective view of a carton made from the blank of FIG. 1 which has been loaded with bottles showing both dispenser openings.

The carton loaded with bottles is illustrated in FIG. 2. It will be noted from FIG. 3 that the bottle B has a smaller neck N than bottom. The bottle has a cap C near the top. The bottles are loaded into the carton so that their bottoms rest on bottom panel 14.

The dispenser flap 78A or 78B can be opened by pushing push tabs 71A or 71B in and grasping the end of dispenser flap 78A or 78B along cut line 75A or 75B and commence pulling the dispenser flap 78A or 78B shown in FIG. 2, to remove a selected flap and provide access to the bottles within the carton.

It should be realized that while FIG. 1 and FIG. 2 show two dispensers, the carton can easily be constructed with a single dispenser.

Figure 3:
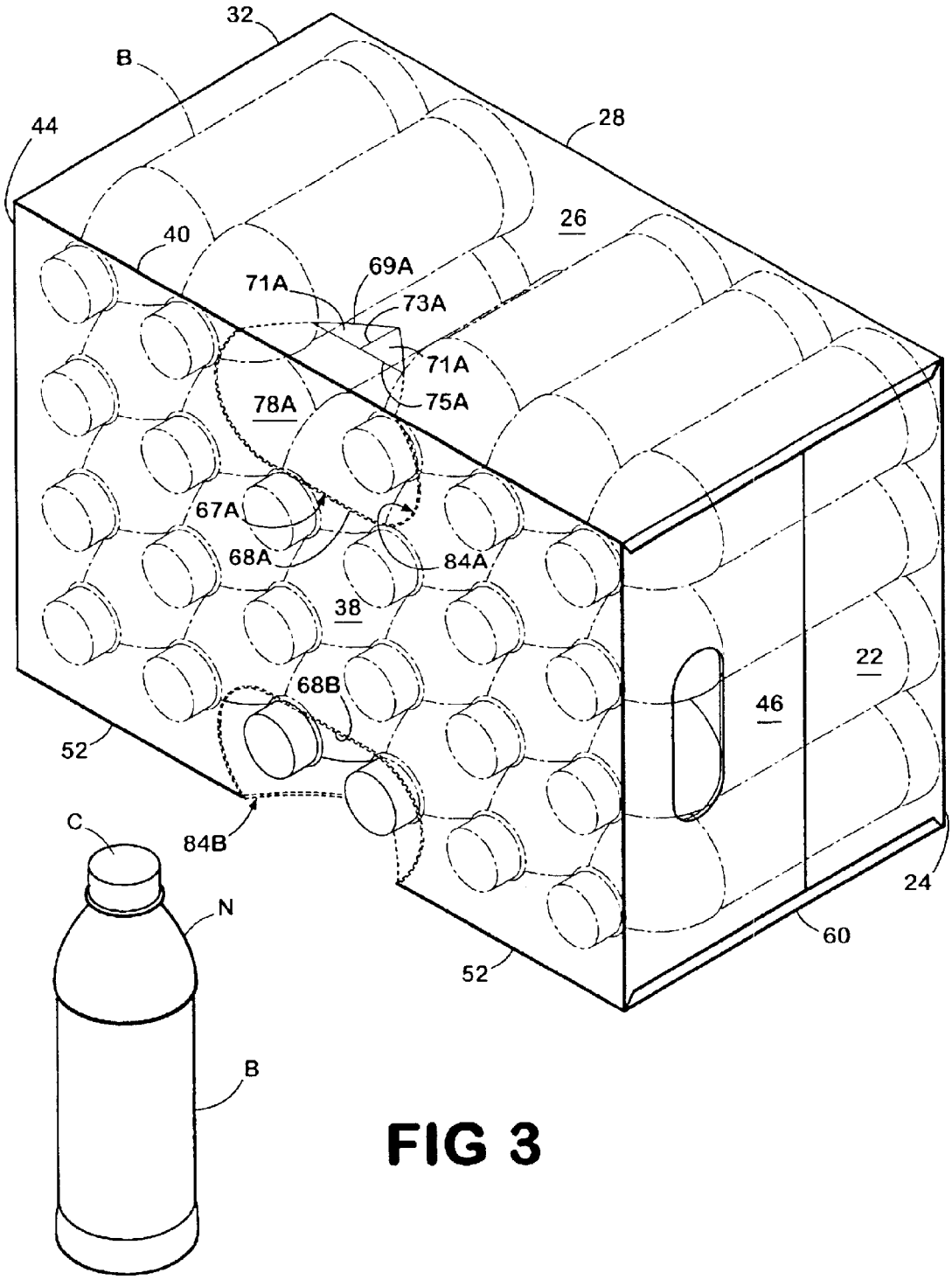
FIG. 3 is a perspective view of the carton with a dispenser flap having been removed exposing one dispenser opening with the carton resting on the side panel adjacent the open dispenser opening.

Once a dispenser flap 78A or 78B has been removed the carton can be rotated 90 degrees so that it rests on the side panel adjacent to the dispenser opening 84A (not shown) or 84B, as shown in FIG. 3. The bottles can be pulled from the dispenser opening 84B one at a time. Other bottles will automatically drop into position for being dispensed since the bottles are lying on their sides. Locating the dispenser midway between the ends of the carton prevents bottles from hanging up in the carton during dispensing. It will be observed that the bottles B are placed in the carton with their longitudinal axes normal to top panel 38 and bottom panel 14 with the cap C of the bottle being adjacent to the top panel 38. The dispenser opening 84B is placed near the midpoint between fold lines 44 and 48 so that bottles tend to drop towards the dispenser opening 84B. The dispenser opening 84B extends into side panel 50 in order to facilitate having push tabs 71B to open the dispensing flap 78B and also to provide a large enough dispenser opening 84B to ensure easy removal of the bottles from the dispenser opening 84B. The exact size and configuration of the dispensing opening 84B is dependent upon the size and configuration of the bottles. Whether the dispensing opening 84B needs to extend into side wall 50 or is formed exclusively in top panel 38 is dependent upon the size, configuration of the bottles B and the size of the dispenser opening 84B in top panel 38. Putting the dispenser in the top panel permits the carton to be carried by the handles when the dispenser is open.

Figure 4:
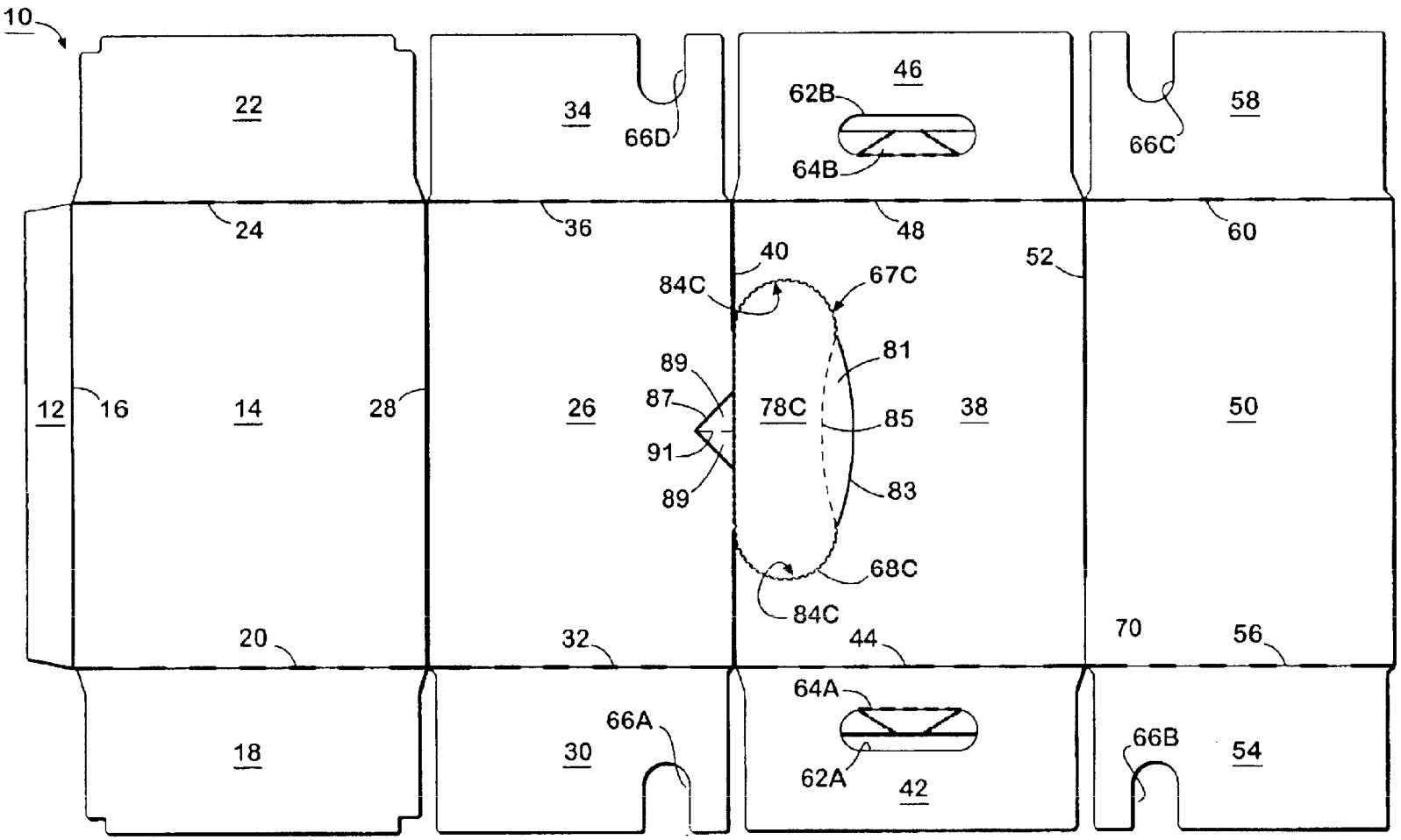
FIG. 4 is a plan view of a blank from which a carton according to another embodiment of this invention is formed.

FIG. 4 is a plan view of a blank from which a carton according to another embodiment of this invention is formed which is identical to the plan view of FIG. 1 except for the number, location and configuration of the dispenser. The carton formed from this blank is also designed to hold 24 bottles. The blank illustrated in FIG. 4 has the same numbers for the blank except for the dispenser, and the carton is folded and loaded with bottles and glued in the same manner as the carton formed from the blank illustrated in FIG. 1. This dispenser 67C is formed by a resistant tear line 68C in top panel 38 near tear fold line 40. It will be noted that resistant tear line 68C extends along a portion of fold line 40. It will be noticed that dispensing flap 78C is located approximately at the mid point between fold lines 44 and 48.

Figure 5:
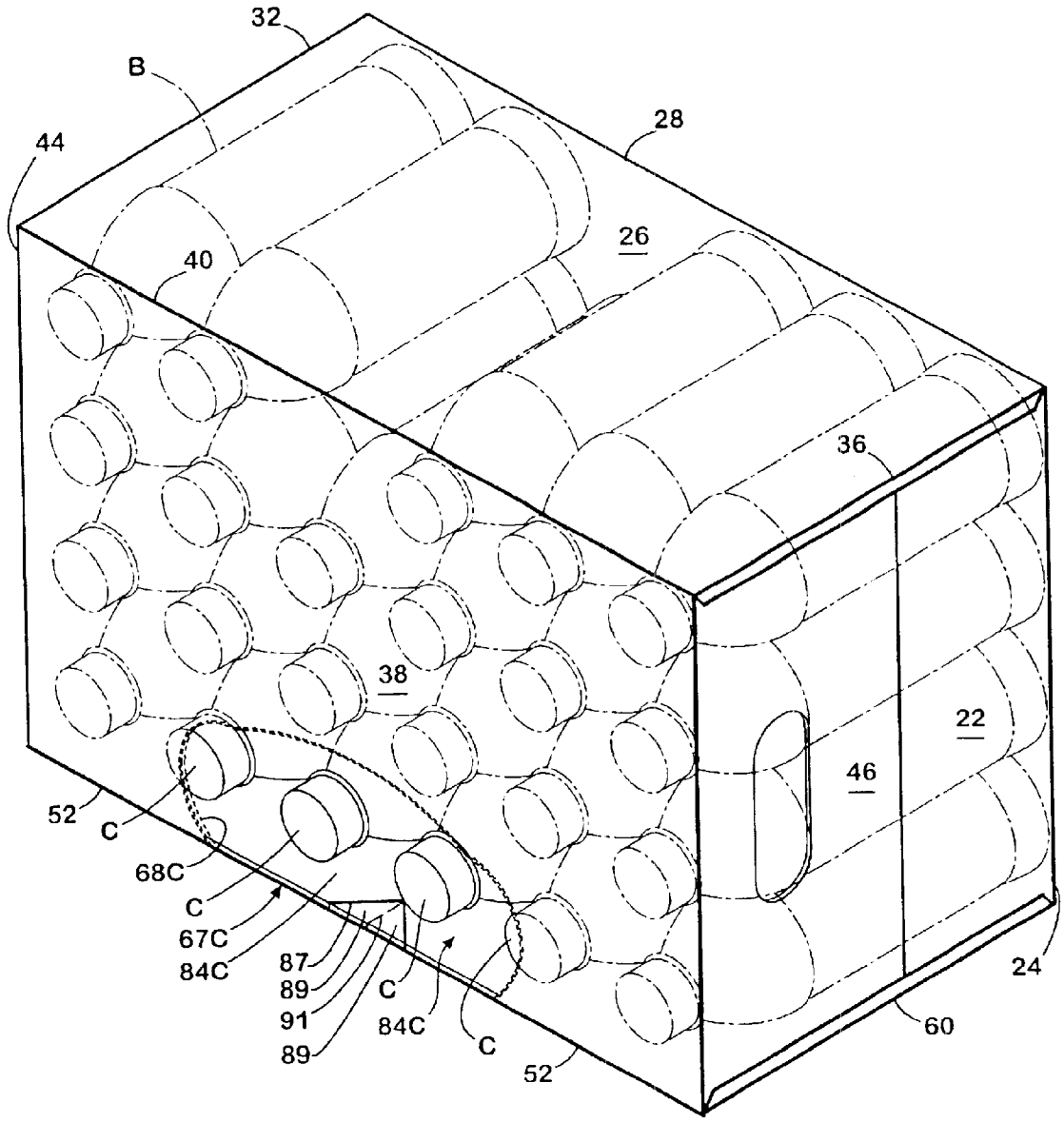
FIG. 5 is a perspective view of the top of the carton loaded with bottles with the carton resting on the side panel adjacent the dispenser opening showing the bottles in a position to be removed.

The dispensing flap 78C is provided with a starting tab 81 which is connected to the top panel 38 by fold line 83 and connected to dispensing flap 78C by tear line 85. V fold lines 87 are provided in side panel 26 between which are formed two push tabs 89 separated by a cut line 91. Tear line 68C extends along push tabs 89. These two push tabs 89 along with starting tab 81 can be pushed inwardly to remove dispensing flap 78C exposing dispenser opening 84C as shown in FIG. 5 when the carton is resting on side panel 26. The dispensing flap 78C can have both, or either, the push tabs 89 and starting tab 81 to aid in opening the dispensing flap 78C. The dispenser opening 84C exposes three bottles for removal one at a time from the carton since the dispenser opening 84C is located midway between the ends of the carton bottles automatically drop into a position adjacent the dispenser opening.

Cartons for holding 12 to 24 bottles, can be designed on the basis of either of these embodiments.

It should be realized that an identical dispenser can be placed along fold line 40 and top panel 38 if desired. As the bottles are removed from the dispenser opening 84C other bottles in the carton roll into position to be removed.

Figure 6A:
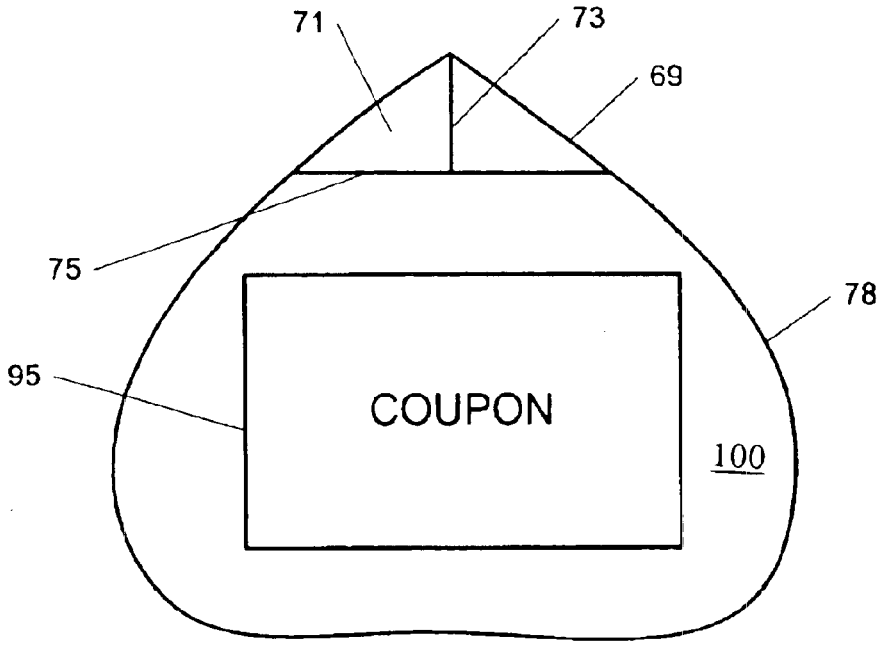
FIG. 6 illustrates a dispenser flap in accordance with the present invention with a coupon attached to the inside of the dispenser flap.
Figure 6B:
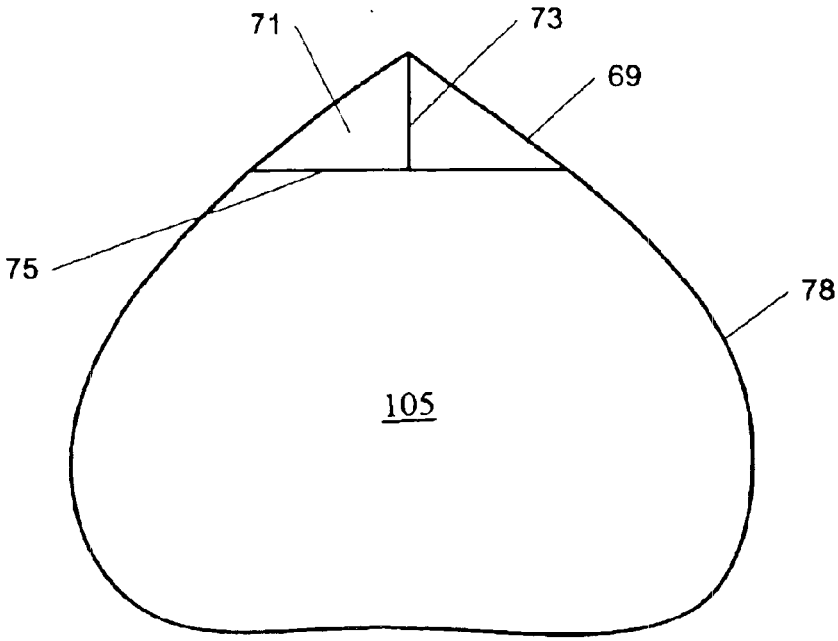
Figure 7A:
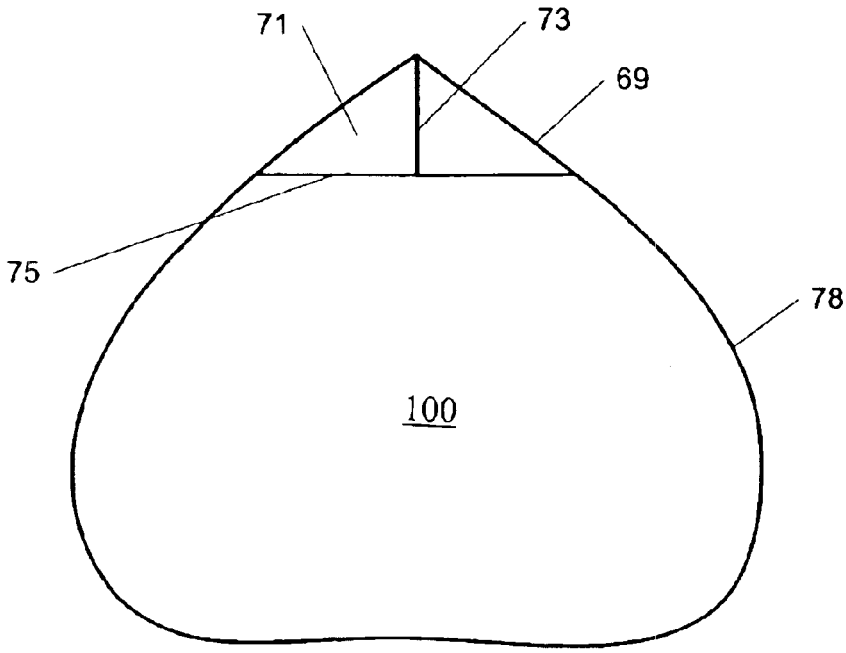
FIG. 7 illustrates a dispenser flap in accordance with the present invention with a coupon attached to the outside of the dispenser flap.
Figure 7B:
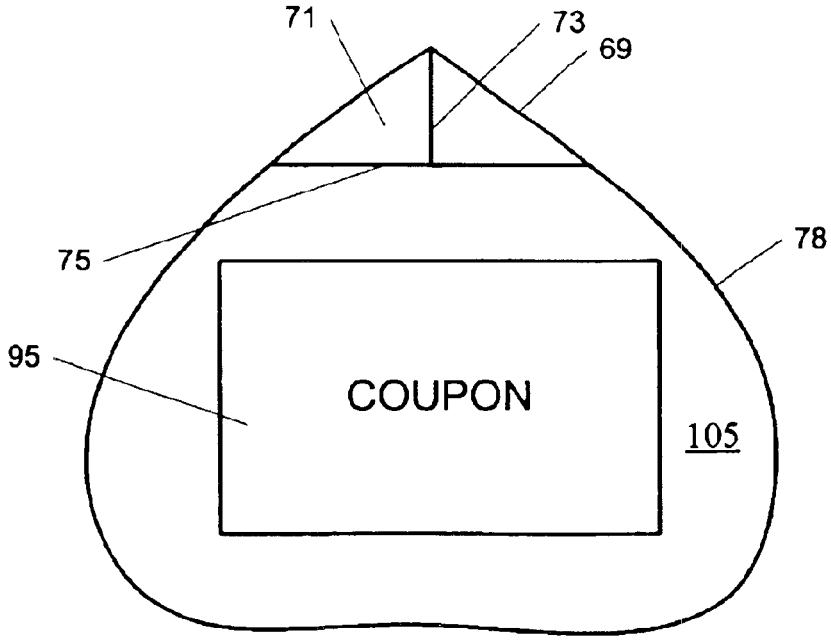

As shown in FIGS. 6 and 7, a coupon 95 can be easily attached to the inside 100 or outside 105 of the dispensing flap for the convenience of the consumer. A coupon 95 can be attached to the inside 100 of the dispensing flap to prevent its removal without the removal of the dispensing flap.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton for carrying a plurality of containers, each container of the plurality of containers having substantially the same size and shape and having a top end and a bottom end, each bottom end having a bottom diameter, the carton comprising:

(a) a bottom panel, top panel, first and second adjoining side panels attached to the top panel by first and second fold lines, and ends which are closed by foldably attached end flaps, the longitudinal axis of each container of the plurality of containers being perpendicular to the planes of the top and bottom panels and the top end of each container being located adjacent the top panel; and (b) a first dispenser opening located in the top panel and the first adjoining side panel, the first dispenser opening having a height approximately equal to the bottom diameter of one container of the plurality of containers;

the first dispenser opening having a width equal to two to three times the bottom diameter of one container of the plurality of containers;

the first dispenser opening being approximately equidistant between the ends of the carton;

the first dispenser opening optionally being closed by a dispenser flap that is coextensive with the first dispenser opening; and the dispenser flap being defined by a first tear line extending across the top panel and the first adjoining side panel; and each container of the plurality of containers being dispensed through the dispenser opening by gravity feed.

2. The carton of claim 1, further comprising a second dispenser opening located in the top panel and second adjoining side panel.

3. The enclosed carton of claim 1, wherein the width of the first dispenser opening is larger than two times the bottom diameter of one container of the plurality of containers.

4. The enclosed carton of claim 3, further comprising a finger flap adjacent the dispenser flap for tearing the dispenser flap from the carton, the finger flap comprising:

V shaped fold lines in the first adjoining side panel;

two push tabs foldably attached to the V shaped fold lines and located between the V shaped fold lines, the two push tabs being separated from each other by a second tear line;

the push tabs being separated from the dispenser flap by a third tear line; and the push tabs being designed to be pushed inwardly by a person opening the dispenser flap so that a person can grasp the dispenser flap.

5. The enclosed carton of claim 1, wherein the width of the first dispenser opening is slightly larger than three times the bottom diameter of one container of the plurality of containers.

6. The enclosed carton of claim 5, further comprising a finger flap adjacent the dispenser flap for tearing the dispenser flap from the carton, the finger flap comprising:

V shaped fold lines in the first adjoining side panel;

two push tabs foldably attached to the V shaped fold lines and located between the V shaped fold lines, the two push tabs being separated from each other by a second tear line;

the push tabs being separated from the dispenser flap by a third tear line; and the push tabs being designed to be pushed inwardly by a person opening the dispenser flap so that a person can grasp the dispenser flap.

7. The enclosed carton of claim 5, further comprising a starting tab located in the top panel immediately adjacent the dispenser flap, said starting tab being separated from the dispenser flap by a sixth tear line, with said starting tab being connected to the top panel by a third fold line, said starting tab being designed so that a person can easily grasp the dispenser flap to tear it loose from the carton.

8. The enclosed carton of claim 1, wherein the first tear line extends completely around the dispenser flap.

9. The carton of claim 1, further comprising has a coupon attached to the inside of the first dispenser flap.

10. The carton of claim 1, further comprising a coupon attached to the outside of the first dispenser flap.

11. An enclosed carton for carrying a plurality of containers, each container of the plurality of containers having substantially the same size and shape and having a top end and a bottom end, each bottom end having a bottom diameter, the carton comprising:

(a) a bottom panel, top panel, and first and second adjoining side panels attached to the top panel by first and second fold lines, and ends which are closed by foldably attached end flaps, the longitudinal axis of each container of the plurality of containers being perpendicular to the planes of the top and bottom panels and the top end of each container being located adjacent to the top panel; and (b) said top panel having a first dispenser opening sized to be slightly larger than the bottom ends of two containers of said plurality of containers, said first dispenser opening extending partially into the first adjoining side panel, said first dispenser opening being located approximately equidistant between the ends of the carton adjacent the first fold line between the top panel and the first adjoining side panel, said dispenser opening optionally being closed by a dispenser flap that is co-extensive with the first dispenser opening, said dispenser flap being attached to said top panel by a first tear line that extends around said dispenser flap, said first tear line having sufficient attachment points to resist tearing by the containers in the carton that are adjacent said dispenser flap, said carton having V shaped fold lines in the first adjoining side panel, said V shaped fold lines having two push tabs foldably attached to said V shaped fold lines, with said push tabs located between said V shaped fold lines, said two tabs being separated by a second tear line, said push tabs being separated from the dispenser flap by a third tear line, said push tab being designed to be pushed inwardly by a person opening the dispenser flap so that a person can grasp the dispenser flap for tearing it from the carton.

12. The carton of claim 11, further comprising a second dispenser opening located in the top panel and second adjoining side panel.

13. An enclosed carton for carrying a plurality of containers, each container of the plurality of containers having substantially the same size and shape and having a top end and a bottom end, each bottom end having a bottom diameter, the carton comprising:

(a) a bottom panel, top panel, and first and second adjoining side panels attached to the top panel by first and second fold lines, and foldably attached end flaps, the longitudinal axis of each container of the plurality of containers being perpendicular to the planes of the top and bottom panels and the top end of each container being located adjacent the top panel;

(b) a first dispenser opening located in the top panel adjacent the first fold line between the top panel and the first adjoining side panel, the first dispenser opening having a height approximately equal to the bottom diameter of one container of the plurality of containers;

the first dispenser opening having a width approximately equal to three times the bottom diameter of one container of the plurality of containers;

the first dispenser opening being approximately equidistant between the ends of the carton;

the first dispenser opening optionally being closed by a dispenser flap that is coextensive with the first dispenser opening; and the first dispenser flap being defined by a first tear line that extends around said dispenser flap; and (c) a finger flap comprising:

V shaped fold lines in the first adjoining side panel;

two push tabs foldably attached to the V shaped fold lines and located between the V shaped fold lines, the two push tabs being separated from each other by a second tear line;

the push tabs being separated from the dispenser flap by a third tear line; and the push tabs being designed to be pushed inwardly by a person opening the dispenser flap so that a person can grasp the dispenser flap.

14. The enclosed carton of claim 13, further comprising a starting tab located in the top panel immediately adjacent the dispenser flap, said starting tab being separated from the dispenser flap by a fourth tear line, with said starting tab being connected to the top panel by a third fold line, said starting tab being designed so that a person can easily grasp the dispenser flap to tear it from the carton.

15. An enclosed carton for carrying a plurality of containers, each container of the plurality of containers having substantially the same size and shape and having a top end and a bottom end, each bottom end having a bottom diameter, the carton comprising:

(a) a bottom panel, top panel, first and second adjoining side panels attached to the top panel by first and second fold lines, and ends which are closed by foldably attached end flaps, the longitudinal axis of each container of the plurality of containers being perpendicular to the planes of the top and bottom panels and the top end of each container being located adjacent the top panel; and (b) a first dispenser opening located in the top panel and the first adjoining side panel, the first dispenser opening having a height approximately equal to the bottom diameter of one container of the plurality of containers;

the first dispenser opening having a width approximately equal to two times the bottom diameter of one container of the plurality of containers;

the first dispenser opening being approximately equidistant between the ends of the carton;

the first dispenser opening optionally being closed by a dispenser flap that is coextensive with the first dispenser opening; and the dispenser flap being defined by a first tear line extending across the top panel and the first adjoining side panel.

16. An enclosed carton for dispensing a plurality of containers by gravity feed, each container of the plurality of containers having substantially the same size and shape and having a top end and a bottom end, each bottom end having a bottom diameter, the carton comprising:

(a) a bottom panel, top panel, first and second adjoining side panels attached to the top panel by first and second fold lines, and ends which are closed by foldably attached end flaps, the longitudinal axis of each container of the plurality of containers being perpendicular to the planes of the top and bottom panels and the top end of each container being located adjacent the top panel; and (b) a first dispenser opening located in the top panel and the first adjoining side panel, the first dispenser opening having a height approximately equal to the bottom diameter of one container of the plurality of containers;

the first dispenser opening having a width approximately equal to two times the bottom diameter of one container of the plurality of containers;

the first dispenser opening being approximately equidistant between the ends of the carton;

the first dispenser opening being closed by a dispenser flap that is coextensive with the first dispenser opening; and the dispenser flap being defined by a first tear line extending across the top panel and the first adjoining side panel.

17. An enclosed carton for dispensing a plurality of containers by gravity feed, each container of the plurality of containers having substantially the same size and shape and having a top end and a bottom end, each bottom end having a bottom diameter, the carton comprising:

(a) a bottom panel, top panel, first and second adjoining side panels attached to the top panel by first and second fold lines, and ends which are closed by foldably attached end flaps, the longitudinal axis of each container of the plurality of containers being perpendicular to the planes of the top and bottom panels and the top end of each container being located adjacent the top panel; and (b) a first dispenser opening located in the top panel adjacent the first fold line between the top panel and the first adjoining side panel, the first dispenser opening having a height approximately equal to the bottom diameter of one container of the plurality of containers;

the first dispenser opening having a width approximately equal to three times the bottom diameter of one container of the plurality of containers;

the first dispenser opening being approximately equidistant between the ends of the carton;

the first dispenser opening optionally being closed by a dispenser flap that is coextensive with the first dispenser opening; and the dispenser flap being defined by a first tear line extending across the top panel and the first adjoining side panel.

* * * * *